US009200463B2

(12) United States Patent
Amar et al.

(10) Patent No.: US 9,200,463 B2
(45) Date of Patent: Dec. 1, 2015

(54) MODULAR MULTIPURPOSE PLATFORM AND HARDWARE

(71) Applicant: Comfort Zone Killer LLC, Chelsea, MA (US)

(72) Inventors: Lauren Amar, Boston, MA (US); Samuel Putnam Batchelor, Cambridge, MA (US); Kelly Jean Ard, Boston, MA (US)

( * ) Notice: Subject to any disclaimer, the term of this patent is extended or adjusted under 35 U.S.C. 154(b) by 43 days.

(21) Appl. No.: 13/874,596

(22) Filed: May 1, 2013

(65) Prior Publication Data

US 2014/0325925 A1 Nov. 6, 2014

(51) Int. Cl.
*E04H 3/28* (2006.01)
*E04H 3/24* (2006.01)

(52) U.S. Cl.
CPC ... *E04H 3/28* (2013.01); *E04H 3/24* (2013.01)

(58) Field of Classification Search
CPC ..... E04H 3/28; E04H 3/24
USPC ..... 52/182, 184, 6, 7, 263, 220.1
See application file for complete search history.

(56) References Cited

U.S. PATENT DOCUMENTS

| | | | | |
|---|---|---|---|---|
| 5,392,718 | A * | 2/1995 | Stevens | 108/167 |
| 5,615,451 | A * | 4/1997 | Peterson et al. | 16/34 |
| 7,377,491 | B2 * | 5/2008 | Fuoco | 256/65.03 |
| 7,624,540 | B1 * | 12/2009 | Hayden et al. | 52/6 |
| 7,971,395 | B1 * | 7/2011 | Vigil et al. | 52/9 |
| 2004/0221517 | A1 * | 11/2004 | Jirele | 52/6 |
| 2005/0011135 | A1 * | 1/2005 | Hallberg | 52/7 |
| 2006/0124802 | A1 * | 6/2006 | Ritts et al. | 244/118.5 |
| 2013/0239492 | A1 * | 9/2013 | Cave et al. | 52/126.5 |
| 2013/0333302 | A1 * | 12/2013 | Valente et al. | 52/7 |

* cited by examiner

*Primary Examiner* — Brian Glessner
*Assistant Examiner* — Paola Agudelo
(74) *Attorney, Agent, or Firm* — Intrinsic Law Corp.; Ibrahim M. Hallaj

(57) ABSTRACT

A multipurpose support platform system is disclosed including a variety of configurable components. In some aspects a frame is made from readily available standard materials such as construction lumber and sheet material connected by hardware support units that include metal plates securely joined in a configuration supporting the frame and sheet materials of the platform. Horizontal and vertical wall configurations are permitted, and the overall structure then allows for a secure and protective work surface for a variety of activities.

3 Claims, 11 Drawing Sheets

MODULAR MULTIPURPOSE PLATFORM AND HARDWARE

TECHNICAL FIELD

The present disclosure generally relates to structures for supporting physical objects, persons and activities. More specifically, to a versatile platform that is assembled from construction materials mechanically coupled by way of special hardware.

BACKGROUND

Platform structures are employed to support activities of persons in various endeavors such as construction, manufacturing, art creation, stage performance and others. Generally, a platform structure includes a platform floor, which comprises horizontal planar, rigid surface on which objects, workers and materials are placed. A platform structure may further include walls or extensions for supporting or hanging things and allowing activities beyond just placing them on the horizontal surface of the platform floor.

One group of persons and activities that sometimes employ platform structures is that of artists, including performing artists (e.g., actors, dancers) as well as artists in the act of creating or displaying a physical work product. Artists use platform structures because they provide a solid flat support surface (floor) for conducting their activities, and also to protect the underlying floors of the premises in which the activities are being carried out. For example, an artist who owns or rents an office or apartment space may wish to protect the original floors of the space from damage from the acts used in creating some kinds of artwork. Painting, welding, sawing, grinding, hammering and other acts to create artwork can damage traditional floors.

Merely placing a protective covering (e.g., sheet materials) over the floors of a space may not be adequate for the purpose of protecting the floors in all cases. Also, such simple coverings do not adequately isolate spaces and floors beneath the artist's work space from noise and disturbance associated with the artist's work. In addition, simple sheet coverings lack the versatile multipurpose nature of the structures described below.

SUMMARY

The present disclosure is generally directed to a multipurpose support platform system including a variety of configurable components. In some aspects a frame is made from readily available standard materials such as construction lumber and sheet material connected by hardware support units that include metal plates securely joined in a configuration supporting the frame and sheet materials of the platform. Horizontal and vertical wall configurations are permitted, and the overall structure then allows for a secure and protective work surface for a variety of activities.

Some embodiments are directed to a type of multipurpose platform structure including a frame base including a plurality of rigid elongated frame members arranged along at least one substantially horizontal dimension; a plurality of hardware support units mechanically supporting and interconnecting said plurality of elongated frame members in said frame base; where said hardware support units constructed of metal plates rigidly connected to one another in each hardware support units so as to form facets thereof, including respective slots or tabs extending from said facets for supporting respective ones of the elongated frame members; and a horizontal platform floor comprising at least one sheet of material, supported by and secured to said frame base.

Other embodiments are directed to a kit including various components as described above that are modular and permit relatively easy assembly and design of horizontally and/or vertically arranged platforms.

BRIEF DESCRIPTION OF THE DRAWINGS

For a fuller understanding of the nature and advantages of the present invention, reference is be made to the following detailed description of preferred embodiments and in connection with the accompanying drawings, in which.

DETAILED DESCRIPTION

As mentioned before, the present disclosure is directed to systems for supporting loads, either horizontally or vertically or both. Additionally, the present systems are intended to provide a convenient, clean and protective work surface on which artists, artisans, performers or other workers can conduct their activities without damaging an underlying flooring upon which the multipurpose platform structure is resting. Functional hardware brackets and supports are provided in some instances to permit convenient access to electrical power in the units or to permit storage of tools and implements in the units. In some aspects, commonly found commercially standard materials may be used to form the majority of the frame and work surfaces of the present platforms, including framing lumber and construction sheets such as plywood or similar sheet materials. The hardware support units described can be manufactured by a manufacturer and sold ready for use, or may be created by end users according to a kit of parts and instructions.

Figure 1:
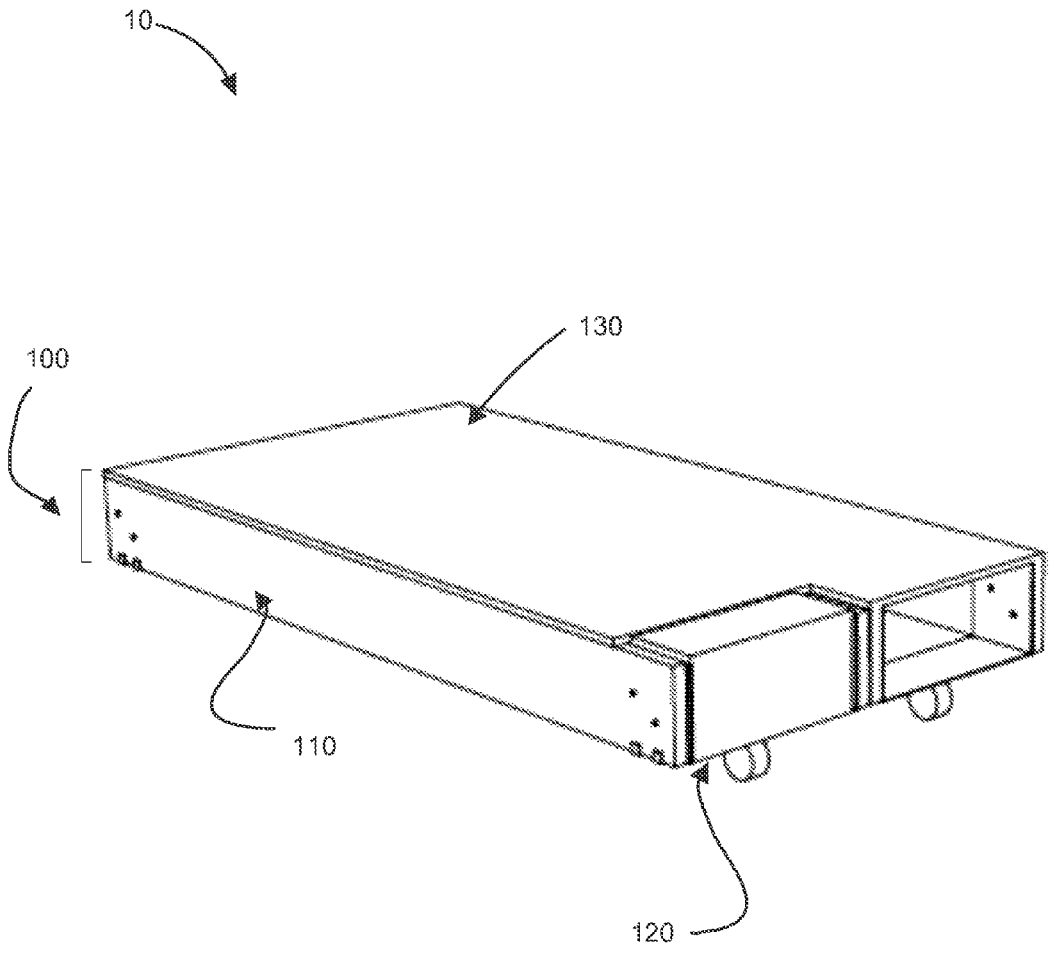
FIG. 1 illustrates an exemplary multipurpose platform having a horizontal platform surface.

FIG. 1 illustrates a multipurpose platform structure 10. The structure 10 comprises a frame base 100 supporting the structure, which includes a plurality of ridged elongated frame members 110 supported by a plurality of hardware support units 120. A horizontal platform floor 130 is supported on top of the frame base 100 and its components.

A preferred embodiment, the frame base 100 includes a plurality of structural timbers or construction support members such as standard 2 by 8 or 2 by 10 lumber frame members 110. The elongated frame members 110 are coupled to one another by the hardware support units 120, which include machined features adapted for receiving and supporting the elongated frame members 110, as shown. The elongated frame members 110 are generally configured along at least one substantially horizontal dimension, usually parallel to the surface on which the multipurpose platform structure 10 rests.

Extensions of the multipurpose platform structure 10 may be added on to the simple example of FIG. 1 so as to provide vertical extensions or other useful surfaces and mechanical members for attaching items such as walls or other tools or implements of the trade.

Figure 2:
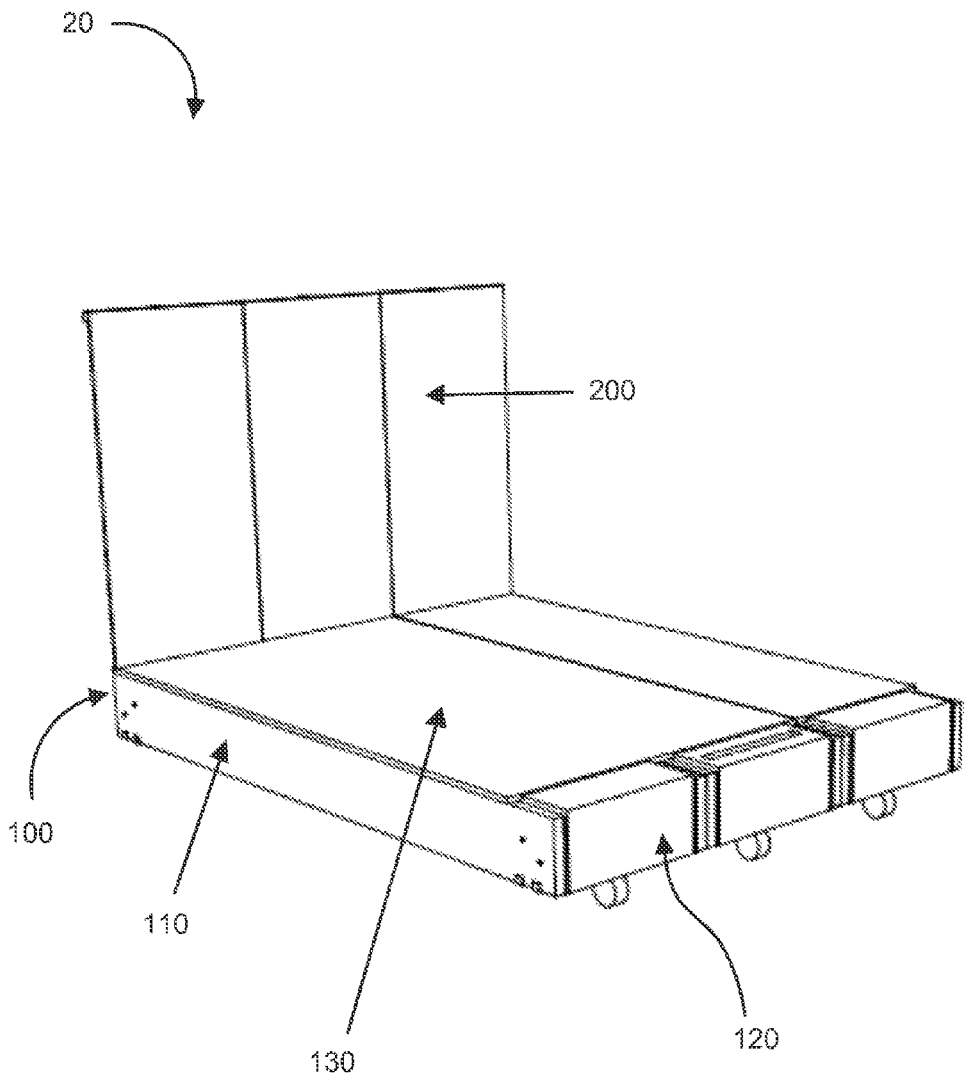
FIG. 2 illustrates an exemplary multipurpose platform having horizontal and vertical surfaces.

FIG. 2 illustrates another embodiment of a multipurpose structure platform 20 including the components described earlier with regard to FIG. 1 as well as a substantially vertical wall 200. The vertical wall 200 is supported by the structure 20 as will be explained in more detail below, and allows a workspace comprising a horizontal workspace on horizontal platform floor 130 as well as a vertical workspace on vertical walls 200.

Figure 3:
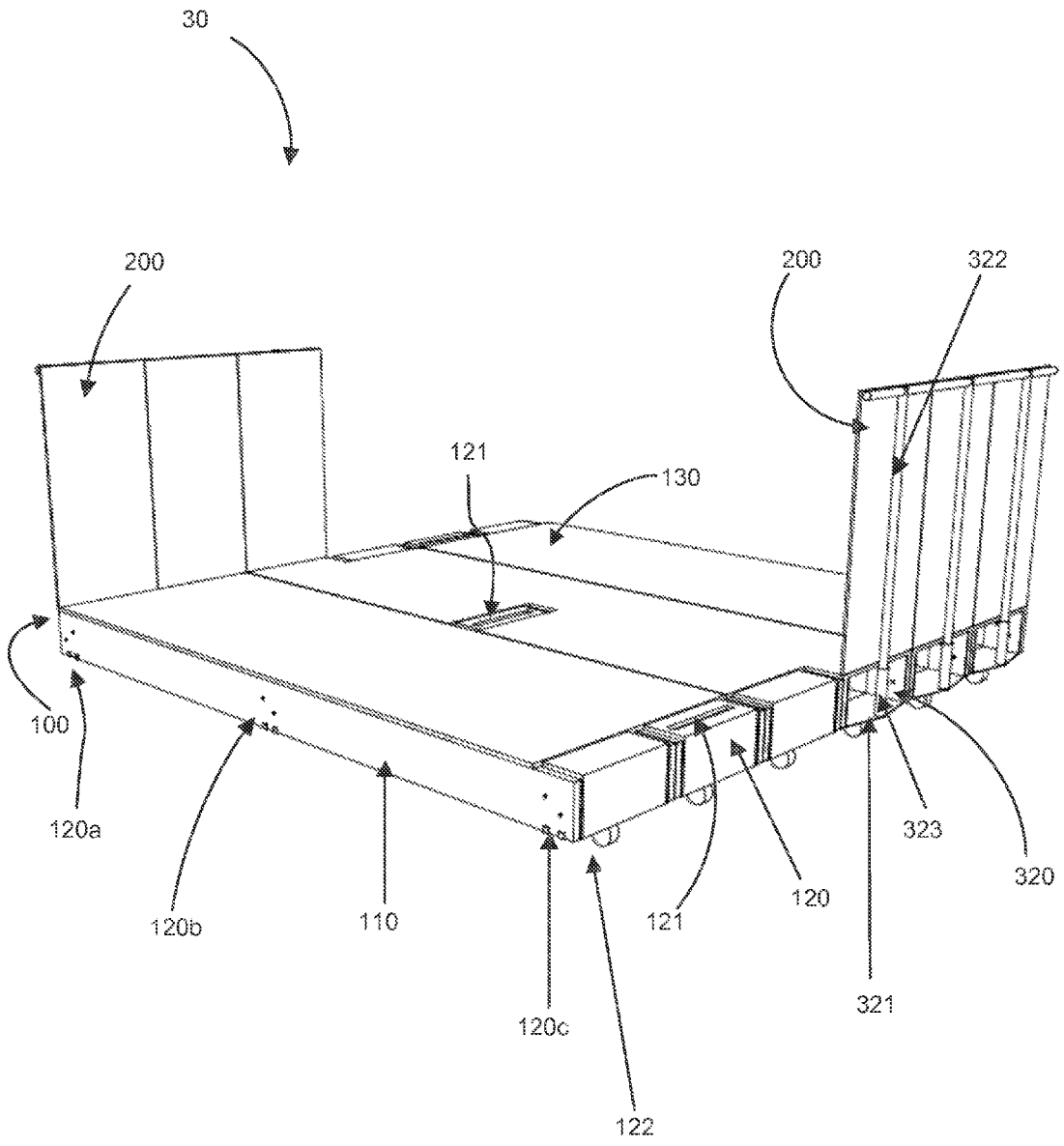
FIG. 3 illustrates another multipurpose platform with a variety of surfaces and hardware components.

FIG. 3 illustrates yet another embodiment of another multipurpose structure 30. This embodiment includes a frame base 100 similar to that described earlier, but which is extended in both length and width as shown to provide a larger horizontal platform floor 130. In some cases where the total surface area of the horizontal platform floor exceeds that available in a convenient commercial format, multiple sheets of a commercially available floor material may be laid out side by side on the frame base 100 to form the total area of the horizontal platform floor 130. For example, standard commercial sheets of plywood measuring 8 feet by 4 feet may be laid out in their entirety or cut to desired sizes so as to tile the needed horizontal surface area of platform floor 130. In the explain shown in FIG. 3, the elongated frame members 110 are of sufficient length to warrant multiple hardware support units 120A, 120B, 120C along the length of elongated frame member 110. The number of hardware support units 120 required to support a given elongated frame member 110 depends on the load intended to be placed on the platform structure as well as the dimensions and strength of the material of the elongated frame members 110. In general, the longer the frame members 110 the more hardware support units 120 are used to support the span of the frame members 110.

As discussed earlier, vertical walls 200 may be secured to one or more locations on the platform structure 30. In FIG. 3 it can be seen that certain ones of the hardware support units 320 have a lateral extension 321 that supports a stub tube 323 suitable for coupling to a vertically disposed rib member 322. The vertical rib member 322 may be connected to the mechanical coupling 323 by insertion of the rib member 322 into a hollow void in vertical coupling 323, or vertical rib 322 may be threaded in a way that mates with the vertical mechanical coupling 323 of hardware support unit 320. A cross member 324 running horizontally may be included at or near the top of vertical rib 322 or in other locations along the height of vertical rib 322 to support the vertical walls 200.

Note that in some embodiments a storage space is provided for storing equipment or other items within hardware support units 120. And in other embodiments, an opening 121 or access slot 121 is provided so that electrical cables or other access may be achieved to the interior of a hardware support unit 120. In yet other aspects, alternating current or direct current power for electrical needs is provided within hardware support units 120, which may be accessed by persons or machines working on the multipurpose platform structure 30 through access ports or slots 121.

Figure 4:
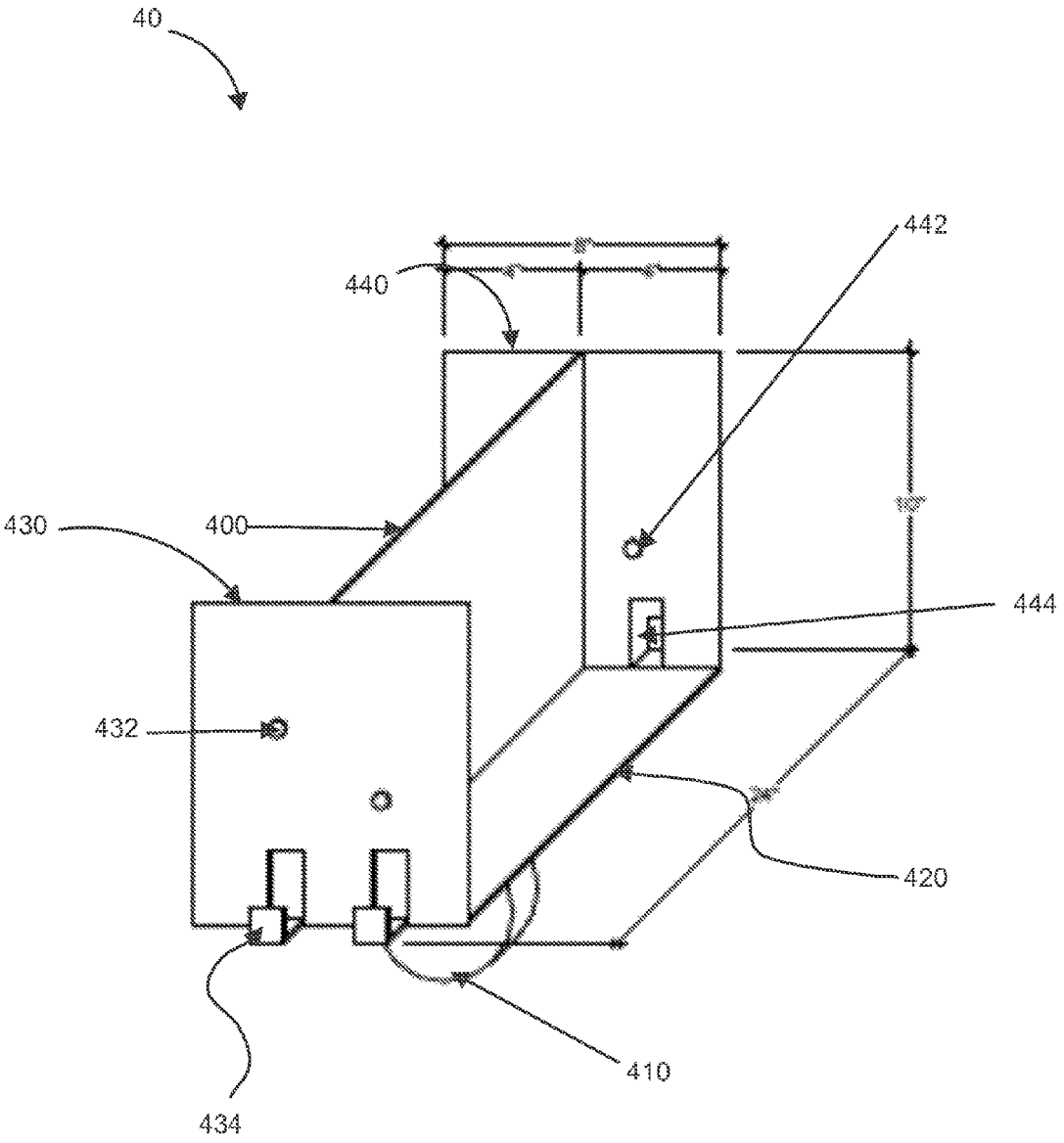
FIG. 4 illustrates an exemplary hardware support unit.

FIG. 4 illustrates one example of a hardware support unit 40. The hardware support unit 40 may be constructed of a solid material such as a metal, for example stainless steel, aluminum, iron or other metallic rigid material as deemed appropriate. Hardware support unit 40 includes a plurality rigidly connected plates 430. For example a central plate 400 may be constructed from a first plate of metal material, which is rigidly joined to a pair of endplates 430 and 440. The plates 400, 430 and 440 may be joined securely to one another by a weld of an appropriate nature that would not fail in use and can support the loads and stresses of the function of the hardware support unit in the multipurpose platforms describes herein. Another plate 420 may be welded to the other three plates so as to form a secure and sturdy support unit capable of holding and retaining the elongated frame members described above.

In the embodiment shown, the endplate 430 includes one or more holes 432 drilled or machined or otherwise formed therein to permit attachment of the elongated frame members to the hardware support unit 430. In this embodiment, the elongated frame members described previously are placed into supporting tabs or slots 434 and are held in these tabs by the force of gravity acting on the weight of the elongated frame members. Once the elongated frame members are placed into the tabs 434 along the side of endplate 430, the elongated frame members may be secured to the mechanical support unit 30 by screws applied through openings 432. In this way the elongated frame member remain securely attached to the hardware support unit 430.

Endplate 440 also serves a similar function as endplate 430 and is shown from the interior view of hardware support unit 40 where a screw hole 442 and a slot from which a tab 444 has been formed are shown. Those skilled in the art would appreciate methods of machining, cutting, manufacturing and making the components of the hardware support unit 40. In one aspect, the main facets or faces of the metal plates of hardware support unit 40, including plates 400, 430, 440 and 420, may be cut from a sheet stock of iron or stainless steel or aluminum or similar metal material. The tabs 434 and 444 may be formed by cutting a suitable rectangular aperture into endplates 430 and 440 then bending these outward from the face of the endplates so as to form a tab dimensioned correctly to hold standard elongated frame members such as 2× construction lumber. Specifically, in an example, the tabs 434 and 444 are created to support a 2-by-10 (standard reference lumber) size elongated frame member or a 2-by-6, 2-by-8, 4-by-4, 4-by-6 or other standard construction material, wooden, aluminum, steel or otherwise.

In addition, a wheel or caster 410 may be attached to the bottom side of plate 420 or to another location on hardware support unit 40 to allow the multipurpose platform structure to be rolled or moved along the surface on which it rests. In an aspect, the inclusion of a wheel or caster 410 reduces or eliminates the damage to a floor on which the structure resides.

Figure 5:
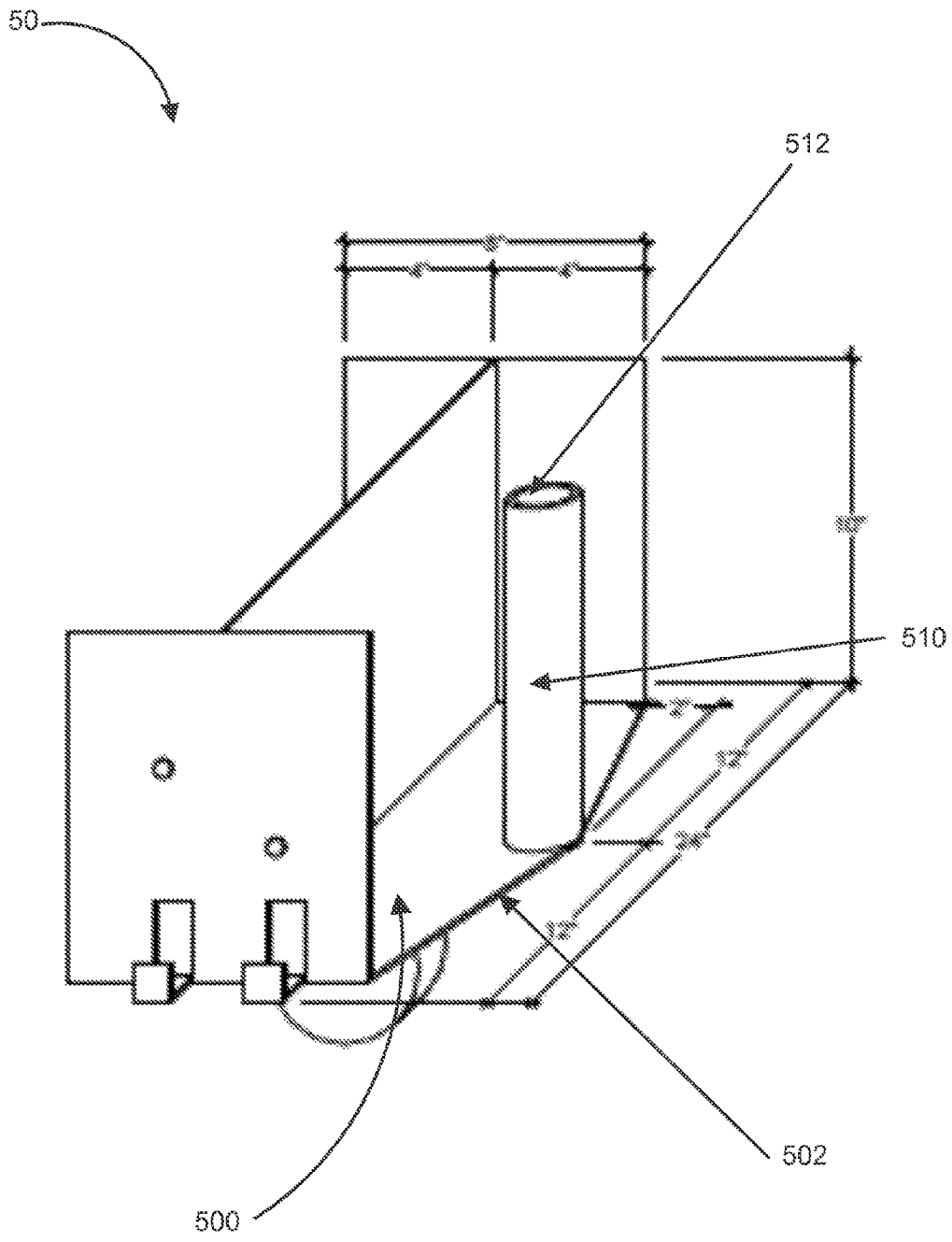
FIG. 5 illustrates an exemplary hardware support unit having a lateral extension for supporting a vertical connection.

FIG. 5 illustrates an exemplary hardware support unit 50 designed to accommodate a vertical extension of a multipurpose platform structure. The various facets of the hardware support unit are similar to those described in the previous figure. However, in this example, the bottom plate 500 includes an extended edge 502 meant to extend beyond the horizontal floor of the platform as shown previously in FIG. 3. The extended edge 502 permits a vertical support element such as stub tube 510 to extend upwardly from the horizontal face of plate 500. The stub tub 510 may be circular in cross section and may be threaded at its upper end 512 so that other pipes or rounded rib members as discussed earlier may be connected to the upper portion of stub tube 510. Alternatively, stub tube 510 may have a round or square or rectangular cross section and suitable dimensioned vertical rib members may fit inside a hollow interior of the stub tube 510 or outside the stub tube 510 by being smaller or larger than the cross section of stub tube 510 respectively.

Figure 6:
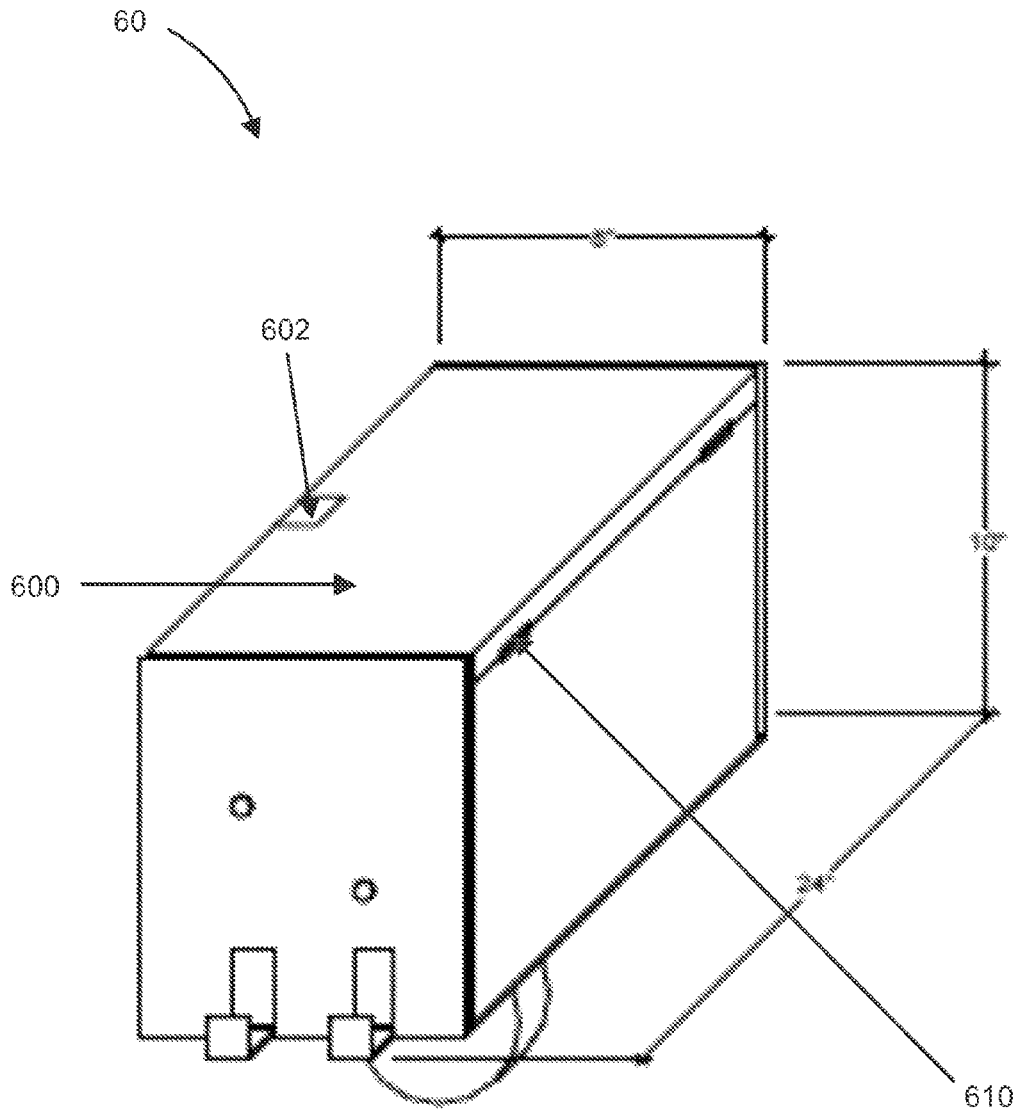
FIG. 6 illustrates an exemplary hardware support unit including a storage box with articulated lid.

FIG. 6 illustrates an exemplary hardware support unit 60 that acts a storage box. Hardware support unit 60 multifaceted ridged plates as described earlier and includes a lid or cover 600 which may pivot to open on pivots or hinges 610, allowing access from above into the interior volume of hardware support unit 60. A finger hole 602 or other handle may be provided for ease of grasp of the cover or lid 600.

Figure 7:
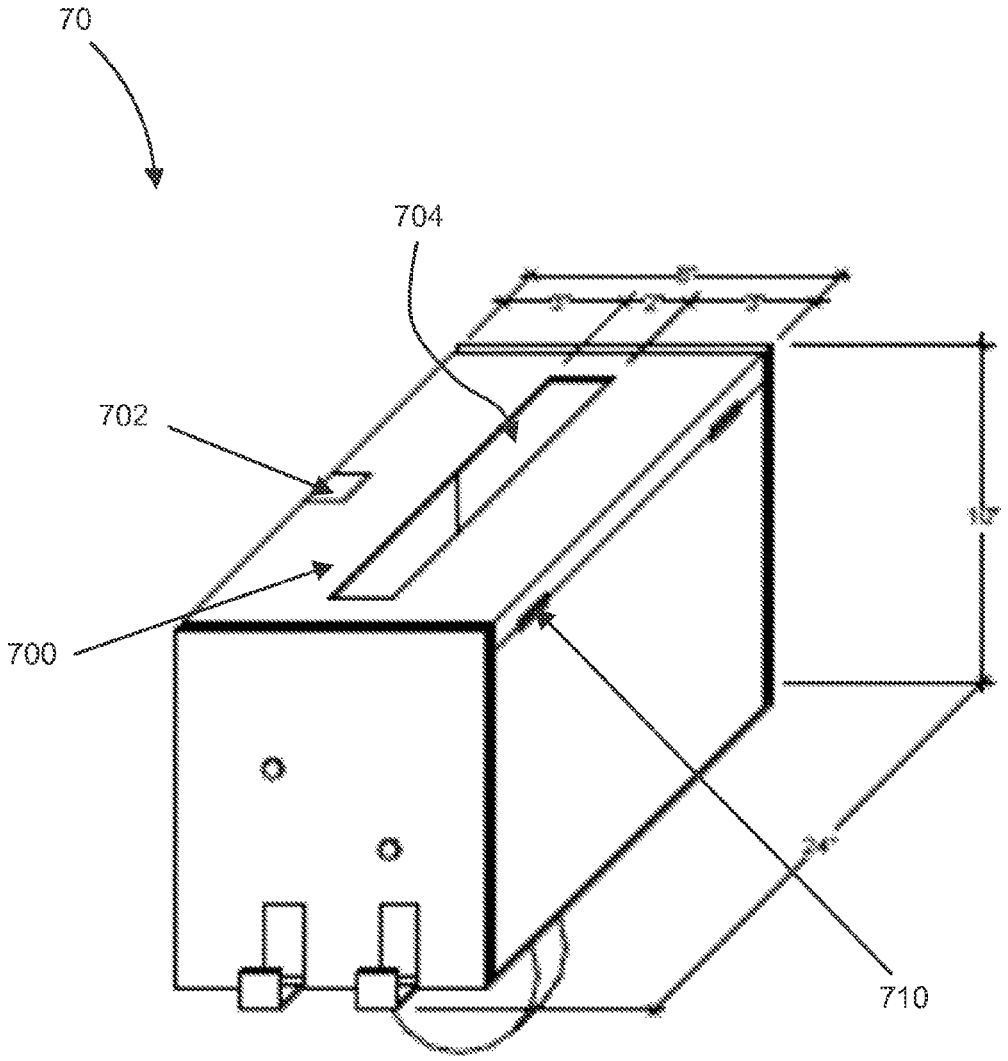
FIG. 7 illustrates an exemplary hardware support unit including a storage box and an access port in its lid.

FIG. 7 illustrates yet another example of hardware support unit 70 having a hinged lid. The unit functions as described before, and has an upper lid or cover 700 attached to the unit by pivots or hinges 710. A finger hole or handle is provided at 7 2 as described previously to allow for opening the cover 700 for access into the interior of hardware support unit 70. In this embodiment, a slot or access port 704 is cut into the upper lid 700 so that an electrical cable or other electronic or communication wire or connector can be passed through the access slot 704 while the lid 700 is shot. In an aspect, a power connector may reside inside of the hardware support unit 70 and connectors or plugs or wires may be passed from outside the lid 700 into its interior through the opening 704 so as to be coupled to the communication port or power source in the box 70.

Figure 8:
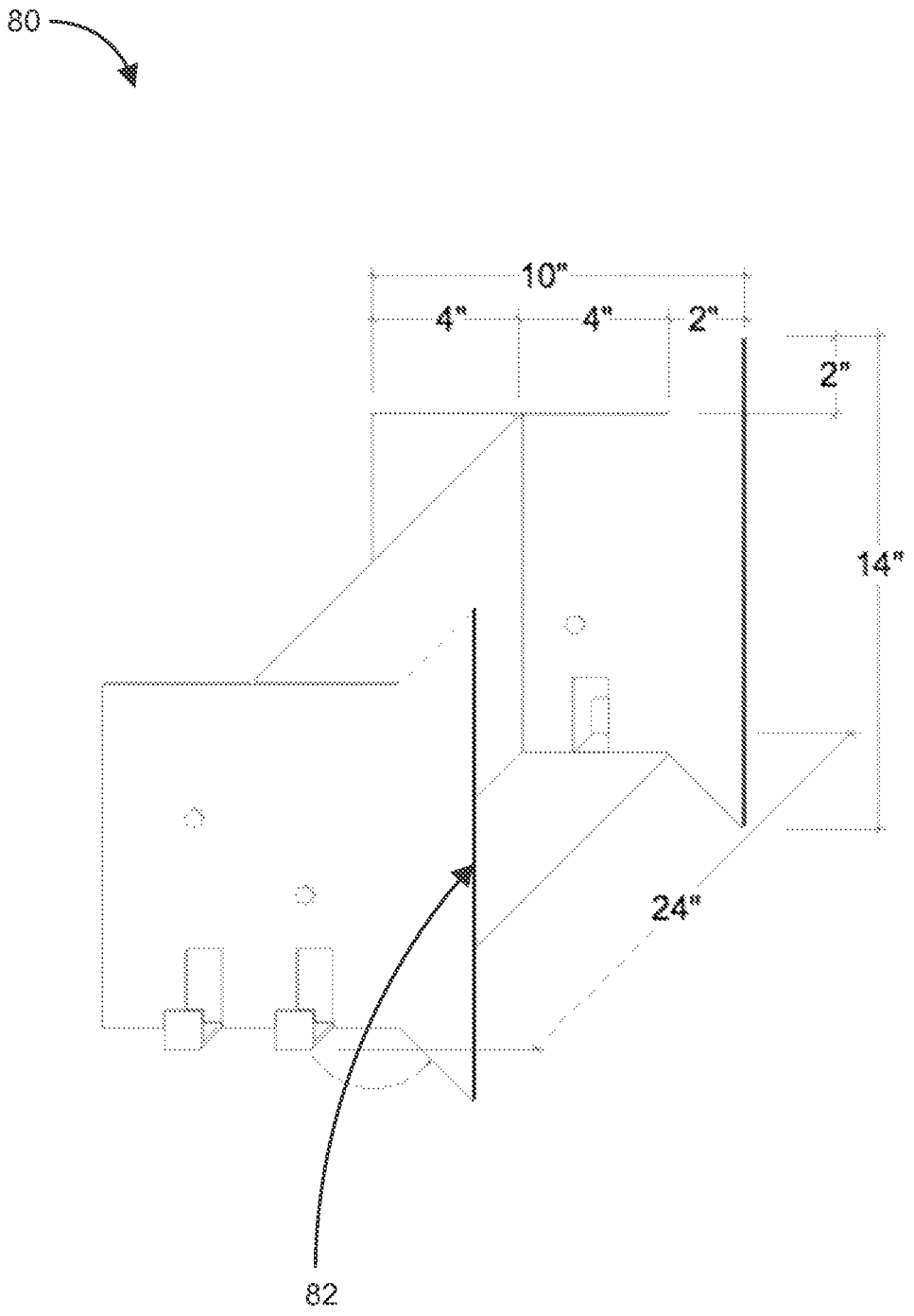
FIG. 8 illustrates an exemplary hardware support unit with a tiltable supportive side.

FIG. 8 illustrates another exemplary embodiment of a hardware support unit 80 having a flat rubberized or otherwise solid side capable of supporting the unit if tilted onto its side (90 degrees to the right in the figure) so as to convert a horizontal floor platform to a vertical wall platform.

Figure 9:
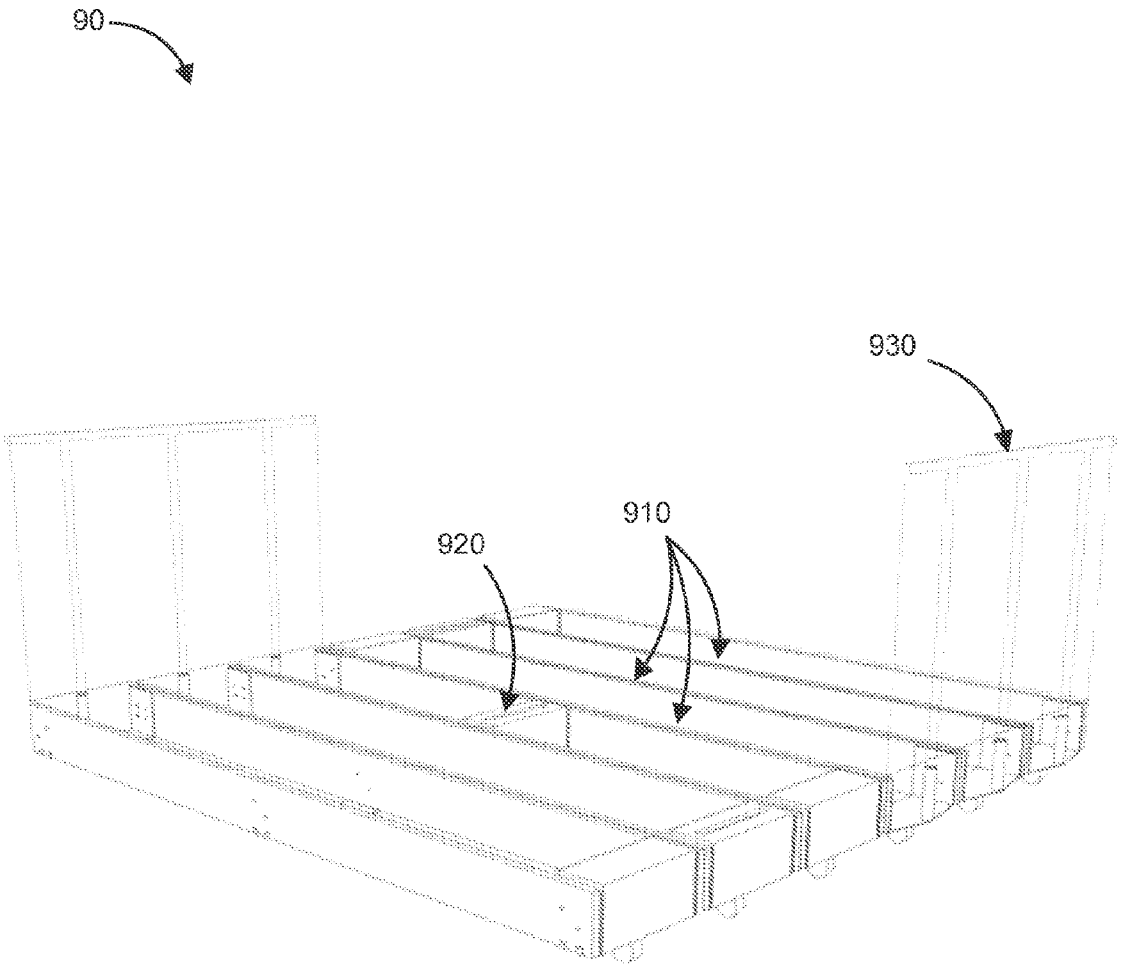
FIG. 9 illustrates a multipurpose platform having the top removed to show the underlying elongated frame members running parallel to one another.

FIG. 9 illustrates an exemplary multipurpose structure 90 where the horizontal sheets are not included so as to illustrate the arrangement of the hardware support units holding the horizontal elongated frame members 910. In the figure, at least of the hardware support units 920 is equipped with a slot permitting access to the interior of hardware support unit 920, which for example can contain electrical outlets or other utilities. Also, the dashed lines illustrate how optional vertical walls 930 may be coupled to the remainder of the structure 90.

Figure 10:
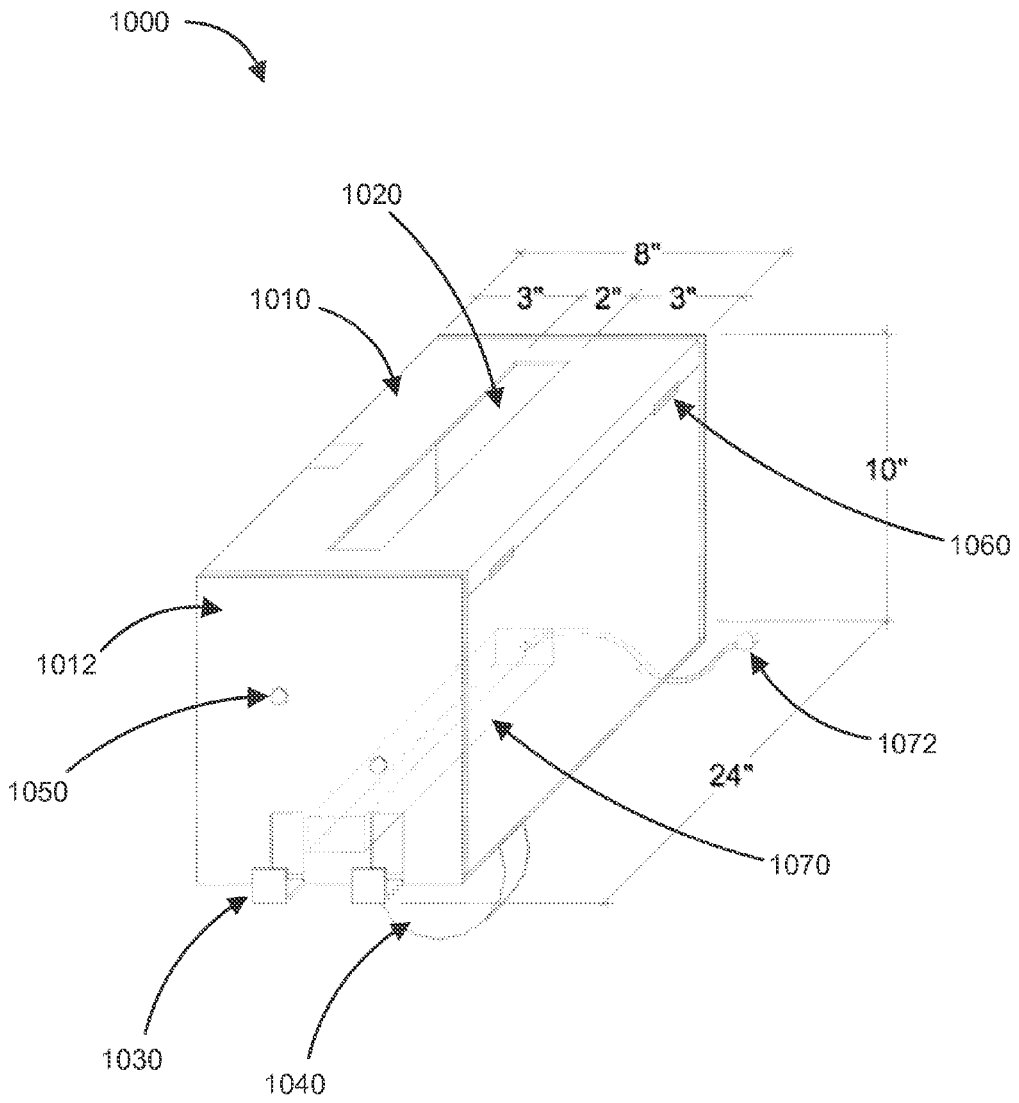
FIG. 10 illustrates a detailed view of an exemplary hardware support unit having NC power outlets and access ports.

FIG. 10 illustrates another detailed embodiment of a hardware support unit 1000. The hardware support unit 1000 may be constructed as mentioned earlier using a plurality of facets including a plurality of vertical facets 1012 joined to horizontal facets such as a top facet 1010. Hinges 1060 can permit opening of the top facet 1010 so as to access its interior.

In some embodiments, an opening aperture or slot 1020 is cut out of the top facet 1010 to allow electrical cords or other utilities to reach into the inside of hardware support unit 1000. In this embodiment, and electrical cord with a plug 1072 provides alternating current power to an outlet strip 1070 inside the hardware support unit. Tabs 1030 permit the placement of elongated frame members such as wood and lumber onto the unit but are not shown in this drawing. Rolling casters or wheels 1040 permit moving of the hardware support unit or rolling of the entire multipurpose platform structure in which it is used if desired. Also, one or more holes 1050 may be drilled into the appropriate facets 1012 to allow bolting or screwing or nailing a elongated frame member to the hardware support unit 1000.

Figure 11:
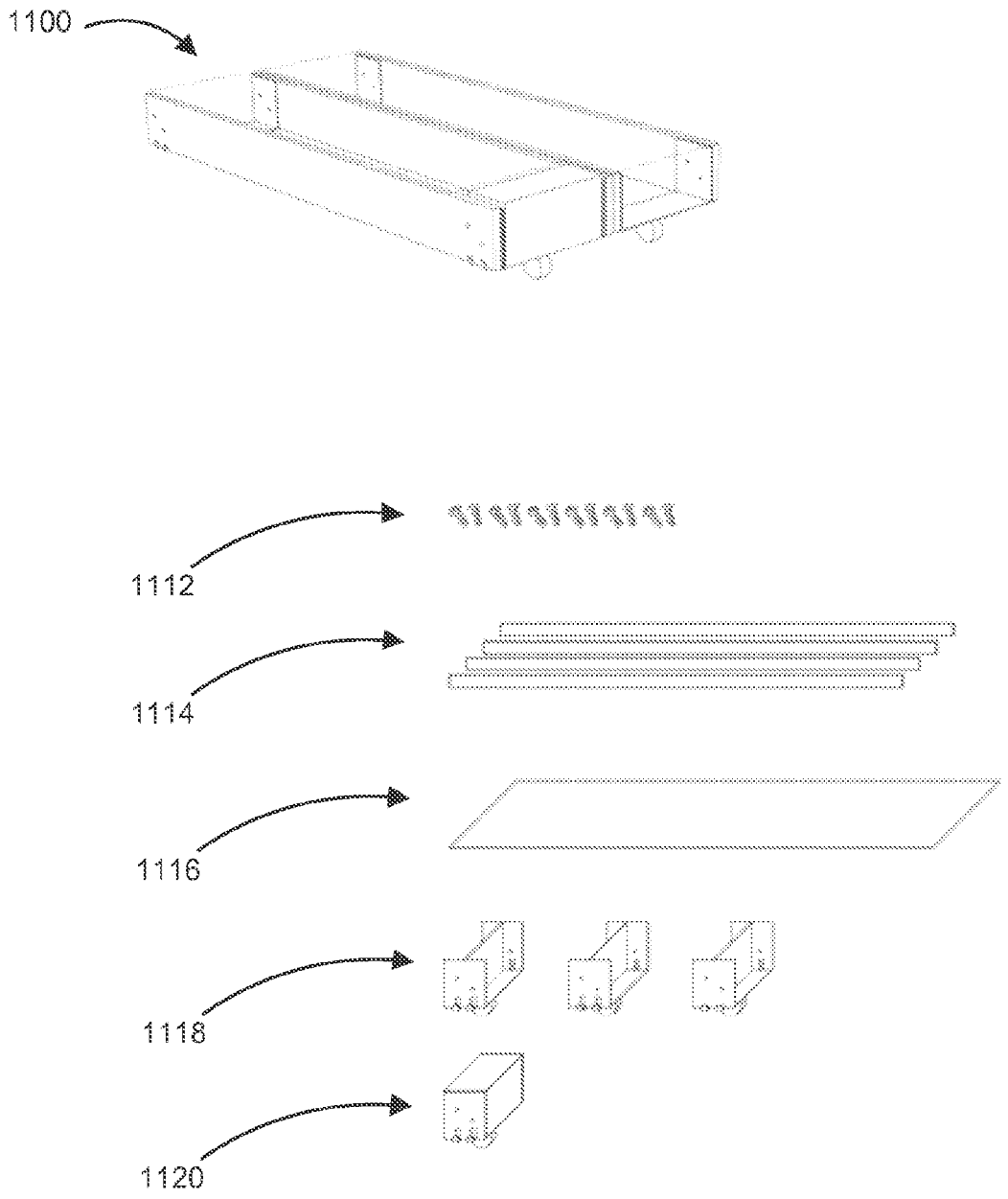
FIG. 11 illustrates a kit for assembling a complete but simple multipurpose platform system.

FIG. 11 illustrates a simple exemplary multipurpose platform structure. Beneath that, some components of a kit are illustrated. The kit includes a plurality of bolts or screws 1112, a plurality of elongated frame members 1114, one or more sheet materials 1116, a plurality of metal hardware support units, and optionally a box type hardware support unit similar to those described earlier.

In some aspects, such a kit can be assembled locally by its end user. Specifically, the end user may purchase from an ordinary hardware store all of the framing and related hardware such as bolts 1112, elongated wooden timbers 1114, and plywood sheets 1116. The end user may purchase from a specialized manufacturer the hardware support units 1118 and 1120. Instructions describing a method for assembly of the components of multipurpose platform structure kit 1100 may also be provided by the manufacturer.

The present invention should not be considered limited to the particular embodiments described above, but rather should be understood to cover all aspects of the invention as fairly set out in the attached claims. Various modifications, equivalent processes, as well as numerous structures to which the present invention may be applicable, will be readily apparent to those skilled in the art to which the present invention is directed upon review of the present disclosure. The claims are intended to cover such modifications.

What is claimed is:

1. A multipurpose platform structure, comprising:

a frame base including a plurality of rigid elongated frame members arranged along at least one substantially horizontal dimension;

a plurality of hardware support units mechanically supporting and interconnecting said plurality of elongated frame members in said frame base;

said hardware support units constructed of metal plates rigidly connected to one another in each hardware support units so as to form facets thereof, including respective tabs extending from said facets for supporting respective ones of the elongated frame members;

a horizontal platform floor comprising at least one sheet of material, supported by and secured to said frame base;

said hardware support unit further comprising an upright coupling member for connection to a vertical rib member capable of supporting objects or walls in a substantially vertical orientation; and said upright coupling member comprising a cylindrical member with one end secured to a facet of a hardware support unit and another end threaded to mate with a compatibly threaded vertical rib member in the form of a pipe.

2. A multipurpose platform structure, comprising:

a frame base including a plurality of rigid elongated frame members arranged along at least one substantially horizontal dimension;

a plurality of hardware support units mechanically supporting and interconnecting said plurality of elongated frame members in said frame base;

said hardware support units constructed of metal plates rigidly connected to one another in each hardware support units so as to form facets thereof, including respective tabs extending from said facets for supporting respective ones of the elongated frame members;

a horizontal platform floor comprising at least one sheet of material, supported by and secured to said frame base;

said hardware support unit further comprising an upright coupling member for connection to a vertical rib member capable of supporting objects or walls in a substantially vertical orientation;

said upright coupling member comprising a cylindrical member with one end secured to a facet of a hardware support unit and another end threaded to mate with a compatibly threaded vertical rib member in the form of a pipe; and said hardware support unit further comprising a horizontal plate with an extended edge extending therefrom and supporting said upright coupling member.

3. A multipurpose platform structure, comprising:

a frame base including a plurality of rigid elongated frame members arranged along at least one substantially horizontal dimension;

a plurality of hardware support units mechanically supporting and interconnecting said plurality of elongated frame members in said frame base;

said hardware support units constructed of metal plates rigidly connected to one another in each hardware support units so as to form facets thereof, including respective tabs extending from said facets for supporting respective ones of the elongated frame members;

a horizontal platform floor comprising at least one sheet of material, supported by and secured to said frame base;

wherein at least one of said hardware support units comprising an interior storage box space therein and having an articulated access hatch permitting access to said interior storage box space.

* * * * *